US009557139B1

(12) United States Patent
Miner et al.

(10) Patent No.: US 9,557,139 B1
(45) Date of Patent: Jan. 31, 2017

(54) ARTICLE OF APPAREL INCLUDING CONCEALED WEAPON POCKET

(71) Applicant: Berne Apparel Company, Berne, IN (US)

(72) Inventors: Christopher S. Miner, Huntertown, IN (US); Kelly A. Alwood, Ashley, IN (US)

(73) Assignee: Berne Apparel Company, Ossian, IN (US)

( * ) Notice: Subject to any disclaimer, the term of this patent is extended or adjusted under 35 U.S.C. 154(b) by 7 days.

(21) Appl. No.: 14/707,855

(22) Filed: May 8, 2015

(51) Int. Cl.

| | |
|---|---|
| ***A41D 13/00*** | (2006.01) |
| ***F41C 33/02*** | (2006.01) |
| ***A44B 18/00*** | (2006.01) |
| ***A44B 17/00*** | (2006.01) |
| ***A41D 27/20*** | (2006.01) |

(52) U.S. Cl.
CPC ..... *F41C 33/0218* (2013.01); *A41D 27/20* (2013.01); *A44B 17/0041* (2013.01); *A44B 18/0073* (2013.01)

(58) Field of Classification Search
CPC .. A41D 27/20; F41C 33/0209; F41C 33/0218; F41C 33/048; A44B 17/0041; A44B 18/0073
USPC ..... 2/69, 94, 247, 248, 249, 250, 251, 253
See application file for complete search history.

(56) References Cited

U.S. PATENT DOCUMENTS 1,067,499 A * 7/1913 Bakke ..... A41D 27/20 2/253
1,134,458 A * 4/1915 Jones ..... A41D 27/20 2/251
1,222,735 A * 4/1917 Coleman ..... A41D 27/20 2/251
1,342,168 A * 6/1920 Gunderson ..... A41D 27/20 2/253
1,448,252 A * 3/1923 Battista ..... A41D 27/20 2/247
2,038,331 A * 4/1936 Woolf ..... A41D 27/20 2/253

(Continued)

FOREIGN PATENT DOCUMENTS

WO WO 02/067717 A1 * 9/2002 ..... A45C 1/04
WO WO 02067717 A1 * 9/2002 ..... A41D 27/20

OTHER PUBLICATIONS

Prior Disclosure Photo 1.

(Continued)

*Primary Examiner* — Anna Kinsaul
*Assistant Examiner* — James Heracklis
(74) *Attorney, Agent, or Firm* — Faegre Baker Daniels LLP

(57) ABSTRACT

An article of apparel includes a concealed weapon pocket positioned at a location on the article of apparel which allow for easy access by a user, such as a lower side portion of a coat or jacket, for example. The front panel includes an upper portion that is releasably secured about its top edge and upper side edges to the main panel, and a lower portion that is fixably secured about its bottom and lower side edges to the main panel. A flap associated with a front cargo pocket may be grasped by hand and moved in a generally forward and downward direction to expose the upper portion of the concealed weapon pocket. The user may then grasp and deploy a weapon disposed in the pocket with minimized structural interference from any portion of the pocket or surrounding apparel structure.

20 Claims, 10 Drawing Sheets

(56) References Cited

U.S. PATENT DOCUMENTS 2,369,208 A * 2/1945 Brangaccio ..... A41D 27/20 2/247
2,383,217 A * 8/1945 Schaffer ..... A41D 27/20 2/253
2,495,582 A * 1/1950 Henderson ..... A41D 13/0012 2/247
2,504,369 A * 4/1950 Adair ..... F41C 33/02 224/672
2,527,224 A * 10/1950 Landy ..... A41D 27/202 2/252
2,678,447 A * 5/1954 Bracken ..... A41D 13/0012 2/94
3,152,339 A * 10/1964 Conville ..... A41D 27/20 2/250
3,537,108 A * 11/1970 Daniels ..... A41D 27/20 2/247
4,356,943 A * 11/1982 Berman ..... A41D 27/20 224/222
4,513,455 A * 4/1985 Gerhardt ..... A41D 27/20 2/246
4,553,269 A * 11/1985 Nowak ..... A41D 27/207 2/254
4,579,265 A * 4/1986 Schiller ..... A45C 1/04 224/222
4,651,355 A * 3/1987 White ..... A41D 27/20 2/247
4,791,681 A * 12/1988 Dean ..... A41D 27/20 2/102
4,796,790 A * 1/1989 Hamilton ..... A45C 11/00 206/438
4,966,320 A * 10/1990 DeSantis ..... A45C 1/04 224/192
5,063,614 A * 11/1991 McSheffery ..... A41D 27/20 2/102
5,072,456 A * 12/1991 Elin ..... A41D 27/20 2/102
5,255,392 A * 10/1993 Stanislaw ..... A41D 27/201 2/247
5,294,031 A * 3/1994 Volpei ..... A45F 3/00 224/192
5,431,318 A * 7/1995 Garcia ..... F41C 33/00 2/2.5
5,495,967 A * 3/1996 Parton ..... A45C 3/06 190/106
5,505,355 A * 4/1996 Williams ..... A45C 1/04 224/243
5,509,147 A * 4/1996 Busquets ..... A41D 27/202 112/441
5,517,696 A * 5/1996 Krugler ..... A41D 27/20 2/247
5,617,582 A * 4/1997 Burwell ..... A41D 13/0012 2/102
5,617,587 A * 4/1997 Marchbanks ..... A41D 27/20 2/247
5,689,829 A * 11/1997 Rose ..... F41C 33/00 2/115
5,692,237 A * 12/1997 Bennett ..... F41C 33/00 2/250
D392,462 S * 3/1998 Brown, Jr. ..... D3/226
5,724,707 A * 3/1998 Kirk ..... A41D 13/0012 2/102
5,784,719 A * 7/1998 Robinson ..... A41D 3/00 2/93
5,884,338 A * 3/1999 Golde ..... A41D 27/20 2/247
5,924,565 A * 7/1999 Colee ..... F41C 33/0218 206/317
5,967,393 A * 10/1999 Clarke, III ..... F41C 33/0218 206/317
5,991,925 A * 11/1999 Wu ..... A41D 13/0012 2/102
6,035,449 A * 3/2000 Galler ..... A41D 27/08 2/247
6,131,198 A * 10/2000 Westrick ..... F41C 33/0209 2/102
6,516,981 B2 * 2/2003 Perez ..... A41D 13/0012 2/102
6,681,404 B1 * 1/2004 Adlard ..... A41D 13/1245 2/94
6,760,922 B1 * 7/2004 Morales ..... A41D 13/0012 2/102
6,810,529 B1 * 11/2004 Reilly ..... A41D 27/20 2/247
7,266,850 B1 * 9/2007 Strum ..... F41H 1/02 2/2.5
7,464,413 B2 * 12/2008 Todd ..... A41D 27/20 2/94
7,631,368 B1 * 12/2009 Samson ..... F41C 33/02 2/115
7,681,255 B2 * 3/2010 Morales ..... A41D 1/06 2/247
7,743,430 B2 * 6/2010 Jennings ..... A45C 1/04 2/94
7,908,675 B2 * 3/2011 Robinson ..... A41D 27/20 2/247
8,307,465 B2 * 11/2012 French ..... A41D 27/20 2/250
8,328,058 B2 * 12/2012 Wilson ..... A45F 3/005 224/243
8,332,967 B2 * 12/2012 Echikson ..... A41B 1/00 2/115
8,371,487 B1 * 2/2013 Plappert ..... F41C 33/0236 224/193
8,484,765 B2 * 7/2013 French ..... A41D 27/20 2/250
8,522,367 B2 * 9/2013 French ..... A41D 27/20 2/250
8,566,963 B2 * 10/2013 Ryan ..... A41D 27/201 2/252
8,719,966 B2 * 5/2014 Grozdev ..... A41D 13/0012 2/247
8,837,464 B2 * 9/2014 Nasielski ..... H04W 68/00 370/259
8,839,464 B2 9/2014 French
8,856,970 B2 10/2014 French
9,009,870 B1 * 4/2015 Connick, Jr. ..... A41D 27/20 2/252
9,144,255 B1 * 9/2015 Perciballi ..... A41D 27/00
2003/0182714 A1 * 10/2003 Mariland ..... A41D 27/20 2/247
2003/0205595 A1 * 11/2003 Young ..... A45F 5/02 224/230
2005/0223466 A1 * 10/2005 Jennings ..... A45C 1/04 2/102
2007/0250980 A1 * 11/2007 Pellerin ..... A41B 9/02 2/69
2008/0256690 A1 * 10/2008 Grilliot ..... A41D 13/0012 2/455
2009/0025117 A1 * 1/2009 French ..... A41D 27/20 2/69
2009/0031468 A1 * 2/2009 Sandoval ..... A41D 1/04 2/69
2009/0265835 A1 * 10/2009 French ..... A41D 27/20 2/227
2009/0282600 A1 * 11/2009 Robinson ..... A41D 27/20 2/79
2010/0050312 A1 * 3/2010 French ..... A41D 27/20 2/69
2010/0083422 A1 * 4/2010 Lebl ..... A41D 27/20 2/251
2011/0030126 A1 * 2/2011 French ..... A41D 27/20 2/250
2011/0191933 A1 * 8/2011 Gregory ..... A41D 13/0012 2/69
2012/0174280 A1 * 7/2012 Strum ..... F41H 1/02 2/69

(56) References Cited

U.S. PATENT DOCUMENTS

| | | | | |
|---|---|---|---|---|
| 2012/0180184 | A1* | 7/2012 | Crye | A41D 13/0007 2/69 |
| 2013/0015225 | A1* | 1/2013 | Hogue | F41C 33/0218 224/587 |
| 2015/0089708 | A1* | 4/2015 | Trevino | A41D 13/0012 2/69 |
| 2015/0144673 | A1* | 5/2015 | Dahl | F41C 33/00 224/587 |
| 2015/0374048 | A1* | 12/2015 | Theodossiou | A41D 13/1245 2/114 |

OTHER PUBLICATIONS

Prior Disclosure Photo 2.
Prior Disclosure Photo 3.
Prior Disclosure Photo 4.
Prior Disclosure Photo 5.
Prior Disclosure Photo 6.
Prior Disclosure Photo 7.
Prior Disclosure Photo 8.
Parts Reference List.

* cited by examiner

ARTICLE OF APPAREL INCLUDING CONCEALED WEAPON POCKET

STATEMENT REGARDING PRIOR DISCLOSURES BY THE INVENTOR OR A JOINT INVENTOR UNDER 37 C.F.R. 1.77(b)(6)

An article of apparel including a concealed weapon pocket, in accordance with the present invention and jointly invented by the present inventors, Christopher S. Miner and Kelly A. Alwood, was publicly shown at the WESA Show in Denver, Colo., USA on Jan. 20, 2015. Prior Disclosure Photos 1-8 showing this article of apparel including a concealed weapon pocket are provided on a concurrently filed Information Disclosure Statement. In each of Prior Disclosure Photos 1-8, features of the concealed weapon pocket described herein are shown with reference numerals corresponding to the reference numerals used in the present application for identical features shown and described in the Detailed Description and drawings. A listing of such reference numerals and their respective corresponding structures is provided with the concurrently filed Information Disclosure Statement.

BACKGROUND

1. Technical Field

The present disclosure relates to an article of apparel having a pocket adapted to carry a weapon in a concealed manner, yet facilitate rapid deployment of the weapon.

2. Description of the Related Art

Many jurisdictions throughout the United States allow for the possession of weapons, such as firearms, on persons for self-defense. Possession of such weapons is typically carried out in a manner in which the weapon is concealed from view to prevent exposing the bearer to a potential threat from another that could result from the weapon being exposed to view or which could potentially raise suspicion or otherwise cause the bearer to be a target of a violent encounter.

While many clothing options exist in the marketplace to aid in the concealment and deployment of concealed weapons, known articles of clothing do not allow extremely rapid deployment of the weapon in the event of an emergency situation while still maintaining a high degree of concealment. When an emergency situation arises in which the bearer is in grave danger of severe bodily harm or death, time is of the essence. In order to maximize concealment, many clothing systems require the bearer to conceal their weapon underneath standard clothing or on the inside of the article of clothing, such as with jackets, vests and other outwear. This requires the wearer to reach inside or underneath their clothing to access their weapon, and therefore provides a greater risk of fumbling the weapon or snagging the weapon on a part of the clothing when removing the weapon from the storage area, in turn sacrificing speed to maintain maximum concealment. Any slight delay in deploying the weapon can potentially have tragic consequences.

What is needed is an improvement over the foregoing.

SUMMARY

The present invention provides an article of apparel, such as a coat or jacket, for example, that includes a concealed weapon pocket. The pocket may be formed by a first panel which is at least partially fixably secured to a main panel of the article of apparel. The pocket is positioned at a location on the article of apparel which allow for easy access by a user, such as a lower side portion of a coat or jacket, for example. The front panel includes an upper portion that is releasably secured about its top edge and upper side edges to the main panel by hook-and-loop fasteners and snap fasteners, and a lower portion that is fixably secured about its bottom and lower side edges to the main panel. A flap, associated with a front cargo pocket disposed exteriorly of the concealed weapon pocket, may be grasped by hand and moved in a generally forward and downward direction to release the hook-and-loop fasteners and snap fasteners and expose the upper portion of the concealed weapon pocket and, in turn, expose the upper portion of a weapon disposed in the pocket. The user may then grasp and deploy the weapon with minimized structural interference from any portion of the pocket or surrounding apparel structure. Advantageously, the present concealed weapon pocket provides for effective concealment of a weapon, yet facilitates rapid deployment of the weapon during a time of need.

In one form thereof, the present invention provides an article of apparel, including: a main panel having a front side; a first panel having a front side, a rear side, and first periphery, the first periphery including a top side, a bottom side, a left side, and a right side, the first panel fixably secured to the main panel along a fixed first seam including the bottom side and a fixed portion of a total vertical extent of each of the left and right sides, the first panel releasably secured to the main panel along a releasable second seam including the top side and a releasable portion of the total vertical extent of each of the left and right sides by hook and loop fastener strips; the fastener strips including first strips fixably secured to and extending respectively along the rear side of the first panel and along the top side and the portions of the vertical extents of each of the left and right sides of the first panel, and second strips fixably secured to and extending along portions of an underlying periphery of the front side of the main panel corresponding to respective locations of the first strips, the first and second strips releasably securable to one another; a first pocket defined between the main panel and the first panel, the first pocket defining an upper portion and a lower portion; the lower portion bounded by the front side of the main panel, the rear side of the first panel, and the fixed first seam, and the upper portion bounded by the front side of the main panel, the rear side of the first panel, and the releasable second seam, the upper portion exposable upon release of the releasable second seam; a second panel defining a second periphery substantially co-extensive with the first periphery, the second periphery including a top side, a bottom side, a left side, and a right side, the second panel fixably secured to the first panel along the bottom side and along each of the left and right sides, with a second pocket defined between the first and second panels; and a flap fixably secured along the top side of the first panel, the flap overlapping the top side of the second panel.

In another form thereof, the present invention provides an article of apparel, including: a main panel having a front side; a weapon mounting panel fixed to the main panel and adapted to receive a weapon system; a first portion of a releasable seam fixed to the main panel and having left side, right side and top portions; a cargo pocket having a non-deployable bottom portion fixed to the main panel by a fixed seam and a deployable top portion releasably secured to the main panel by the releasable seam, the weapon mounting panel disposed between the main panel and the cargo pocket, the fixed seam of the non-deployable bottom portion having a vertical extent of at least 45% of an overall vertical extent defined by the cargo pocket, the cargo pocket including: a first panel having a second portion of the releasable seam secured to a rear side of the first panel, the second portion of the releasable seam having left side, right side and top portions sized and positioned to cooperate with the left side, right side and top portions of the first portion of the releasable seam to selectively secure the deployable top portion to the main panel; a second panel fixed to the first panel with along respective sides and along a bottom, such that the first panel and the second panel cooperate to define the cargo pocket with an open upper end; and a flap selectively covering the open upper end, the flap defining a flap height of at least 3 inches whereby the flap can be firmly grasped by a user of the article of apparel to release the deployable top portion from the main panel.

In yet another form thereof, the present invention provides a method of deploying a weapon from an article of apparel, including the steps of: grasping a top flap of an exterior pocket, the top flap fixably secured along an upper edge thereof to a front panel of the article of apparel, the front panel in turn at least partially fixably secured to a main panel of the article of apparel; translating the top flap in an outward and downward direction with respect to a user to release an upper portion of the front panel from the main panel and to reveal a proximal portion of a weapon disposed within a concealed carry storage area defined between the front panel and the main panel; and removing the weapon from the concealed carry storage area.

BRIEF DESCRIPTION OF THE DRAWINGS

The above-mentioned and other features and advantages of the present disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Figure 1:
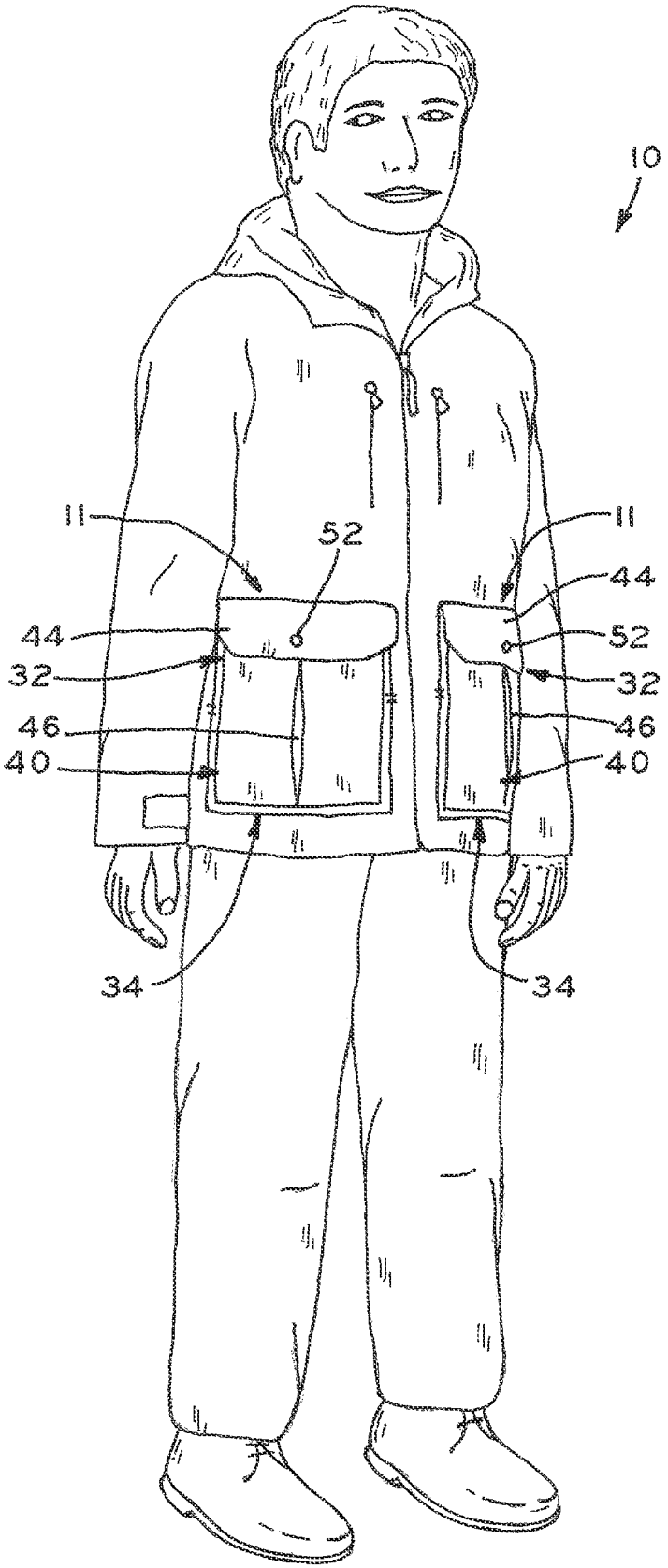
FIG. 1 is a perspective view of a coat made in accordance with the present disclosure, including weapon concealment pockets and worn by a user.
Figure 14:
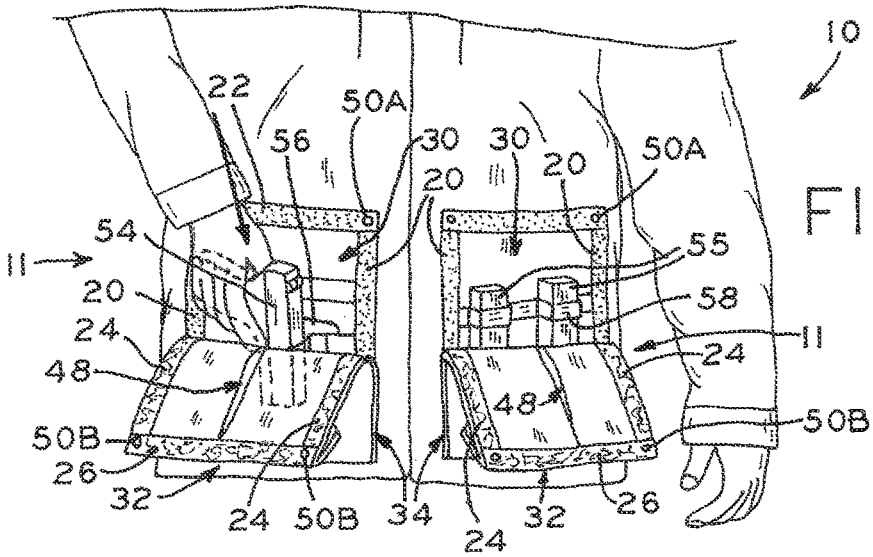
FIG. 14 is another front elevation view of the coat shown in FIG. 12, in which both left and right concealed carry storage areas are fully exposed and the user is grasping a firearm contained in one of the weapon concealment pockets.

The present disclosure provides an article of clothing, such as coat 10 shown in FIG. 1, including one or more weapon concealment pockets 11, such as the left and right pockets 11 shown in FIG. 1. As described in further detail below, weapon concealment pockets 11 provide a versatile, accessible and effective concealed carry storage area 30 (FIG. 4) for secure retention of a weapon system, such as firearm 54 and holster 56 (FIG. 7) and/or related accessories and equipment such as extra ammunition magazines (FIG. 14). Pocket 11 effectively conceals the existence of concealed carry storage area 30 and the presence of a weapon contained therein by eliminating external visual cues suggesting the weapon-bearing capacity of coat 10. For example, structures and materials used for containment of a weapon system within storage area 30, or for accessing storage area 30, are not readily visible. In addition, one or more pleats (e.g., pleats 46, 48 shown in FIGS. 1 and 4) cooperate with the material and construction used for pocket 11 to reduce or eliminate "printing," or outside visibility of the shape of firearm 54 through the fabric of coat 10.

Figure 7:
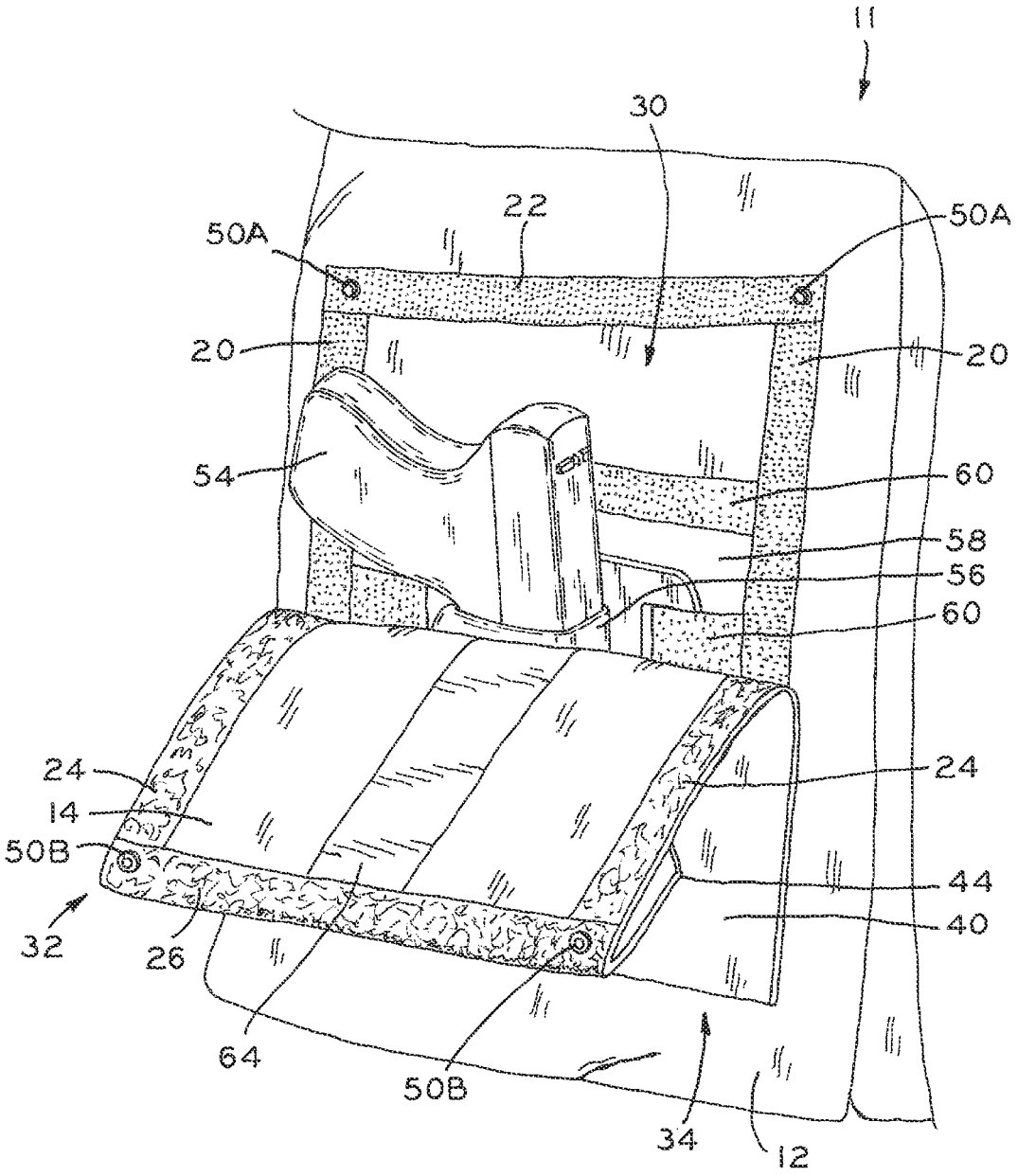
FIG. 7 is a perspective view of the weapon concealment pocket shown in FIG. 4, illustrated with a firearm in the concealed pocket.

Moreover, as described in further detail below, the high degree of concealment provided by coat 10 combines with a fast and simple mode of access into concealed carry storage area 30, including the use of top flap 44 as a grab handle to "tear away" the deployable portion 32 of pocket 11 (FIG. 4) to expose the entire proximal portion of the weapon contained in storage area 30 (e.g., firearm 54 as shown in FIG. 7). This tear-away action and the subsequent retrieval of the weapon uses a fluid and easily accomplished motion, thereby providing a tactical advantage to the user of coat 10 in exigent circumstances which may impair the user's fine motor skills. Thus, concealment pockets 11 of coat 10 provide a superior combination of secure and discrete weapon storage and rapid weapon deployment.

Figure 2:
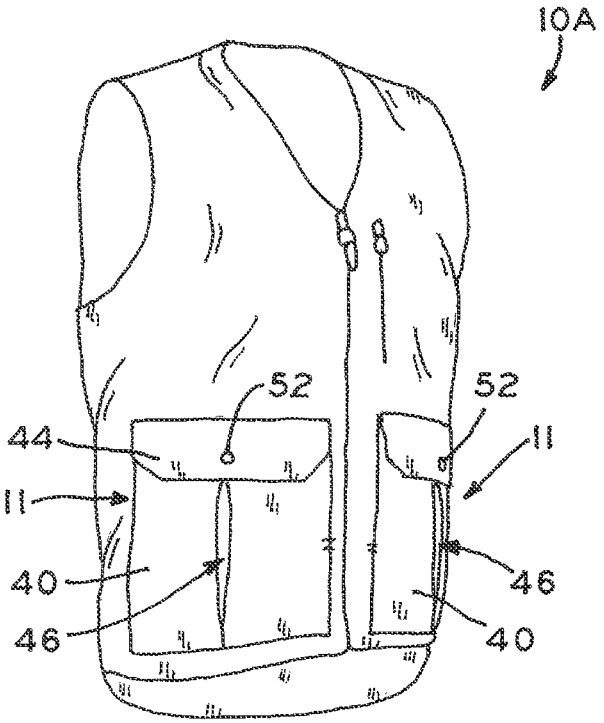
FIG. 2 is a perspective view of a vest made in accordance with the present disclosure.
Figure 3:
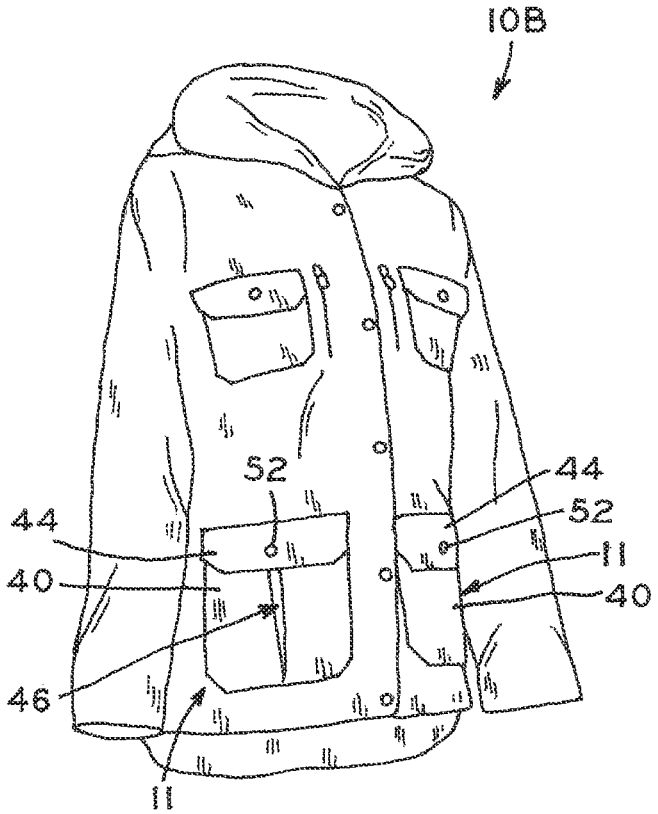
FIG. 3 is a perspective view of a women's coat made in accordance with the present disclosure.

While coat 10 is shown as an illustrative article of clothing in FIG. 1, it is contemplated that other articles of clothing may be provided within the scope and content of the present disclosure. For example, FIG. 2 illustrates vest 10A including left and right weapon concealment pockets 11, while FIG. 3 illustrates a women's parka 10B also containing concealment pockets 11. Moreover, it is appreciated that weapon concealment pockets 11 can be applied to any article of clothing as required or desired for a particular application.

Examples of alternative articles of apparel include cargo pants, coveralls, overalls and other workwear, light jackets, and wearable cargo carriers such as purses, handbags, shoulder bags and backpacks. More generally, concealment pocket 11 can be applied to any article of apparel in which rapid-deployment, concealed weapon storage is desired in a structure which appears as a simple external cargo pocket.

Figure 4:
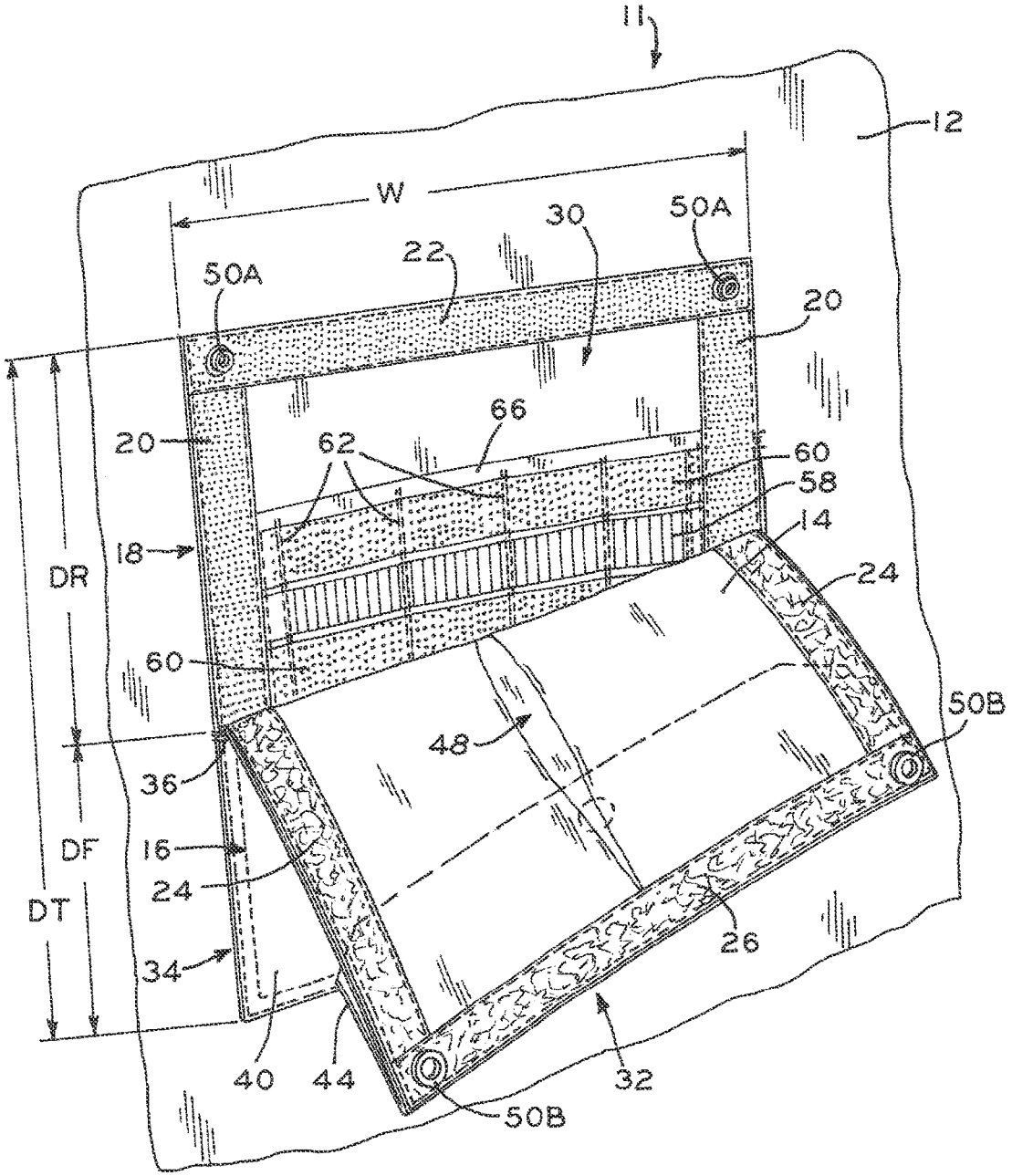
FIG. 4 is a perspective view of the weapon concealment pocket shown in FIG. 1, in which the pocket is in an open configuration with the concealed carry storage area exposed.
Figure 5:
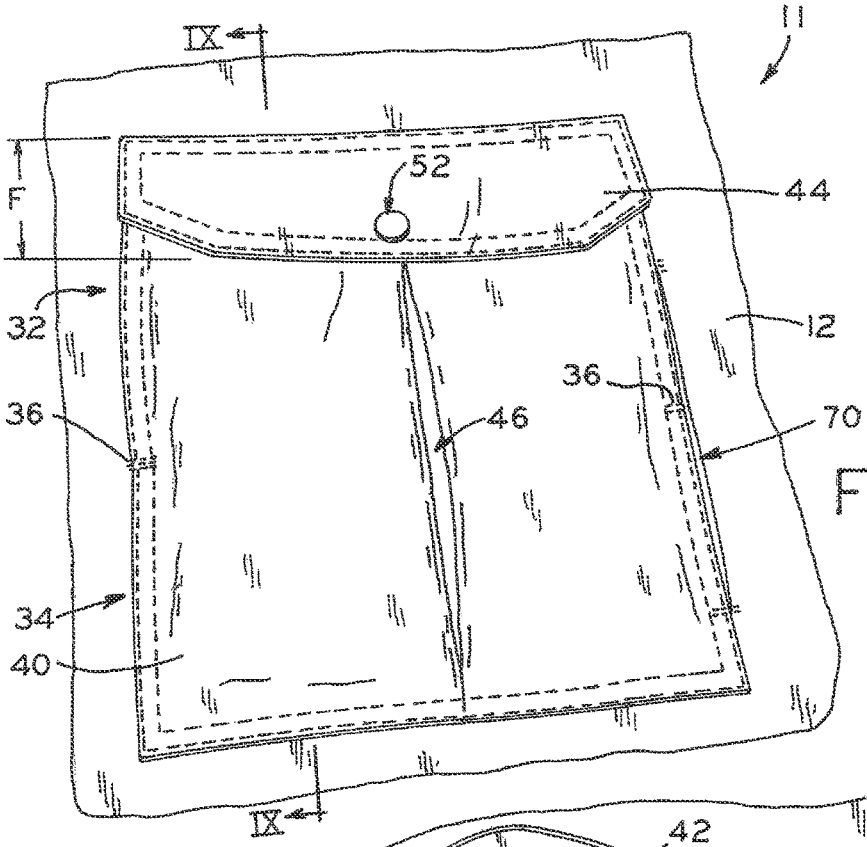
FIG. 5 is another perspective view of the weapon concealment pocket shown in FIG. 1, in which the pocket is in a closed configuration with the concealed carry storage area hidden.
Figure 6:
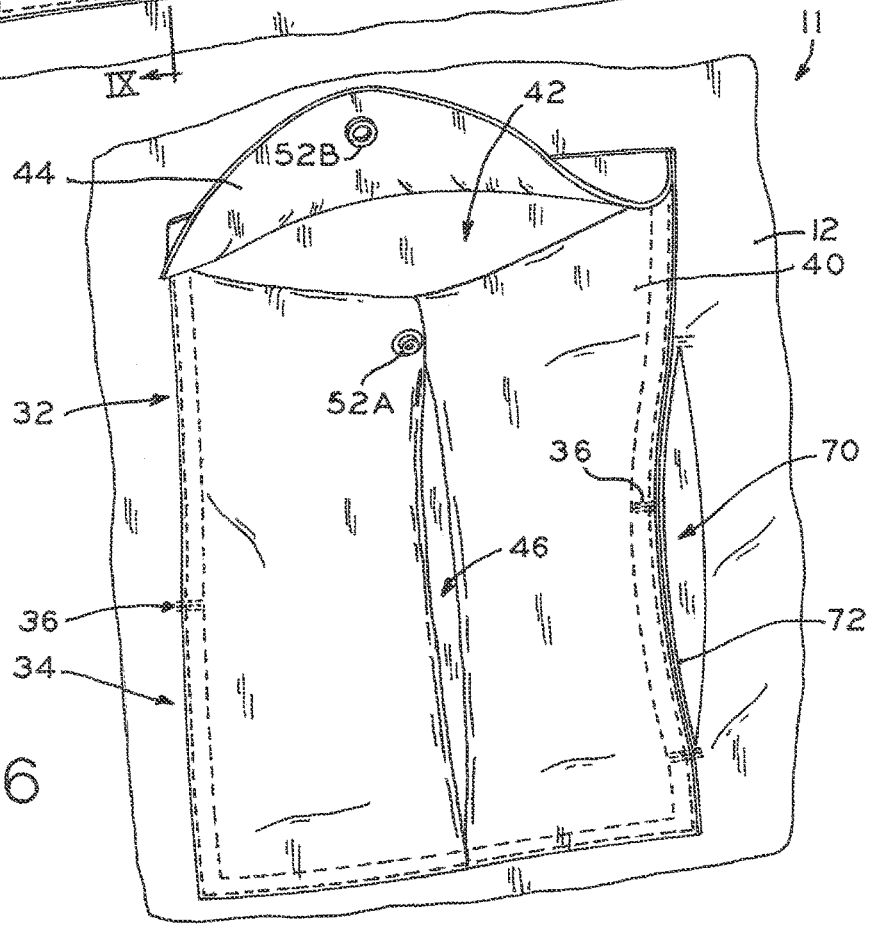
FIG. 6 is a perspective view of the weapon concealment pocket shown in FIG. 5, with the top flap of the standard top access pocket shown in the open configuration.

Turning now to FIGS. 4-6, the structure and function of concealment pocket 11 is illustrated in greater detail. In FIG. 5, pocket 11 is shown in a fully closed configuration, with concealed carry storage area 30 (FIG. 4) not visible and flap 44 in a closed position. In this configuration, all cargo contained in concealment pocket 11 is fully secured and coat 10 is effectively indistinguishable from similar coats lacking provision for weapon concealment. Optionally, insulation or other materials 28 (FIGS. 9 and 10) may be disposed behind main panel 12 to provide warmth for the user.

FIG. 6 illustrates the conventional functionality provided by top access cargo pocket 42 and side access pocket 70, both of which are separate from concealed carry storage area 30. As illustrated, cargo pocket 42 may be accessed by disengaging a central snap fastener 52 (i.e., unsnapping female snap fastener 52B from male snap fastener 52A) and unfolding flap 44. As cargo is added to top access cargo pocket 42, outer pleat 46 may expand to accommodate the volume of the cargo.

Figure 9:
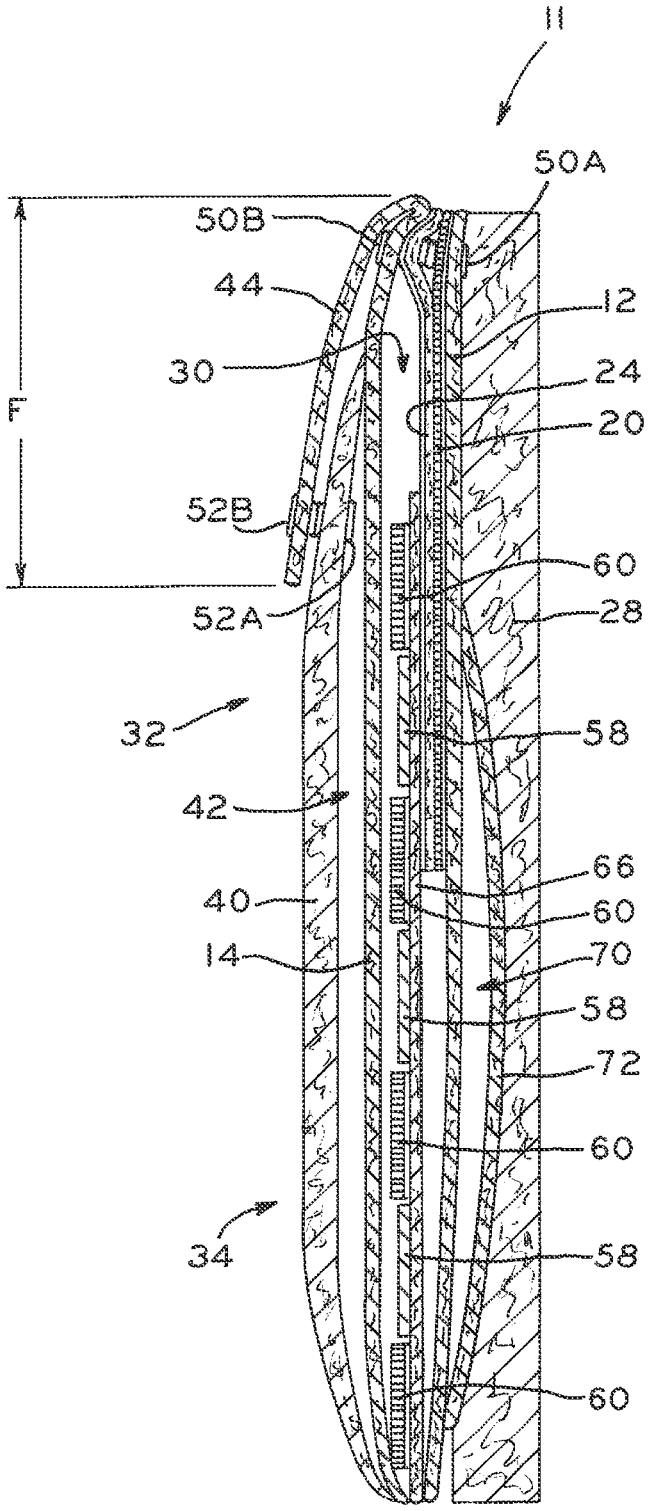
FIG. 9 is a cross-section, elevation view, taken along the line IX-IX of FIG. 5, illustrating the material layers and construction of the weapon concealment pocket.
Figure 10:
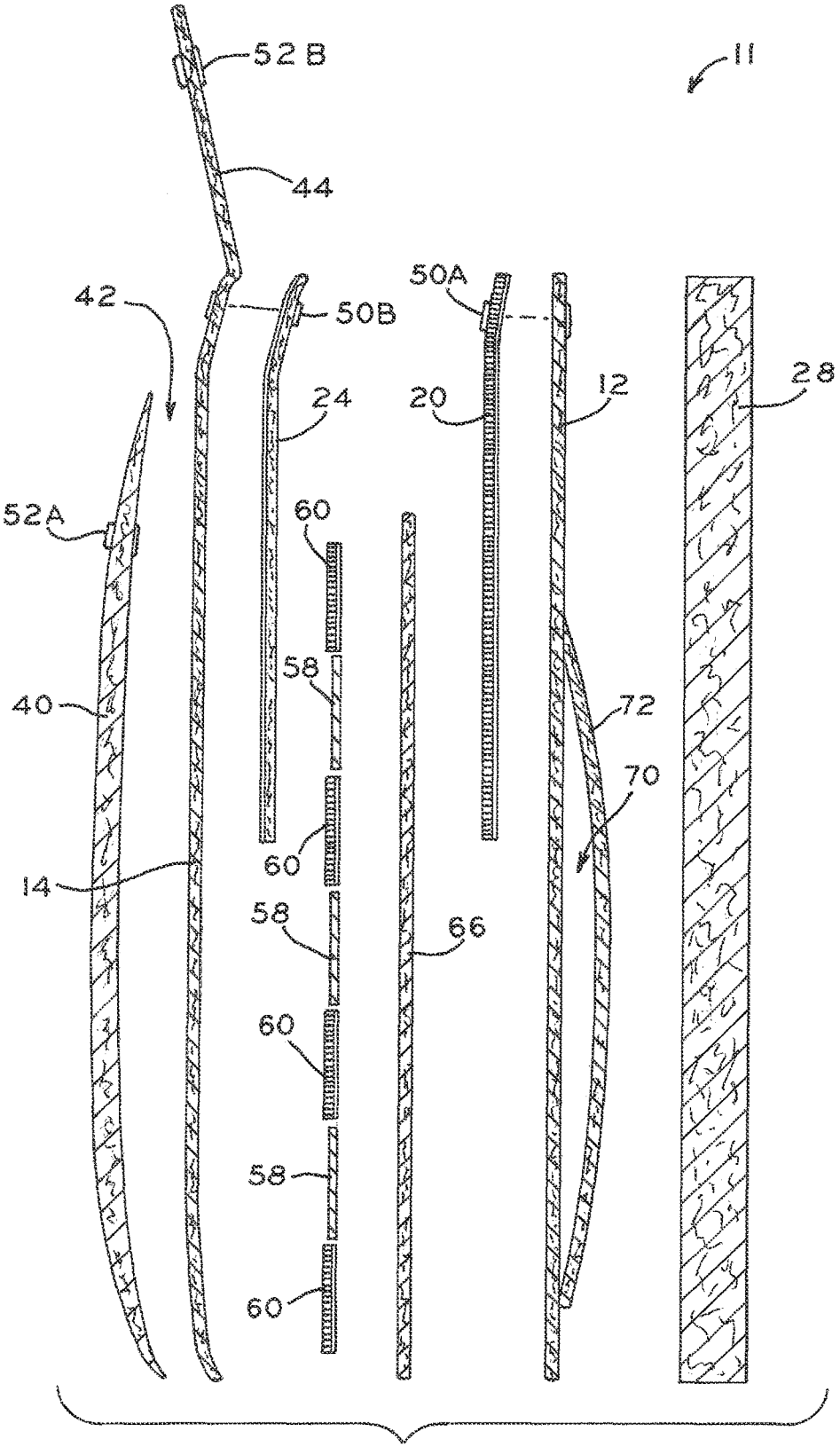
FIG. 10 is a cross-section, elevation, exploded view of the weapon concealment pocket shown in FIG. 9.

Side pocket 70 is accessed by laterally placing cargo through the open slot between main panel 12 of coat 10 and side pocket panel 72. Referring to FIGS. 9 and 10, side pocket panel 72 is secured behind main panel 12, and in front of insulation 28, such that side access pocket 70 is behind the other structures of weapon concealment pocket 11. This arrangement ensures that the presence of cargo and/or weapons contained within concealed carry storage area 30 will not expand the opening to side access pocket 70, thereby avoiding a visual cue of the cargo contained within storage area 30. Rather, side access pocket 70 appears as a typical pocket structure, in registry with the adjacent side of pocket 11, regardless of whether storage area 30 is in use. In an exemplary embodiment, the bottom of the opening for side pocket is about one inch above the bottom of concealment pocket 11, such that cargo contained therein cannot easily roll out, and is at least 6-inches tall to easily accommodate a user's hands and/or cargo. Side pocket 70 may be omitted in some embodiments or coat 10, or in other apparel such as cargo shorts or pants including concealment pocket 11.

Turning back to FIG. 4, concealment pocket 11 is shown with an upper, deployable portion 32 of the conventional cargo pocket 42 "torn away" from main panel 12 to expose concealed carry storage area 30. As described in further detail below, such tearing away may be accomplished by opening flap 44 and using flap 44 as a handle to firmly grasp deployable portion 32, followed by pulling flap 44 and deployable portion 32 outwardly and downwardly to disengage releasable seam 18, which is normally held in place by hooked and looped fastener strips 20, 22, 24, and 26 and/or corner snap fasteners 50. This tearing-away motion facilitates rapid access to the cargo contained in storage area 30 (e.g., firearm 54 as shown in FIG. 7) by a single, fluid and manual movement easily performed using only gross motor skills.

The components assembled to create concealment pocket 11 are best seen in in FIGS. 4, 9, and 10. Main panel 12, which may be the main fabric panel used at the left or right side of coat 10, forms the foundation for attachment of the other structures of pocket 11. Hooked fastener strips 20 are affixed (e.g., by sewing and/or adhesive) to main panel 12 to define one portion of releasable seam 18 along the left and right sides of pocket 11. Similarly, a second hooked fastener strip 22 is fixed to main panel 12 and extends between the side fastener strips 20 to define the top side of pocket 11 and the top portion of releasable seam 18. As best seen in FIG. 4 and further described below, main panel 12 forms the back or inner surface of concealed carry storage area 30.

The front or outer surface of storage area 30 is defined by a first outer panel 14, which also forms the back of cargo pocket 42 as further described below. A lower, non-deployable portion 34 of first outer panel 14 is affixed to main panel 12 by fixed seam 16 (FIG. 4), which extends along a portion of the left and right sides of pocket 11 and across the bottom side of pocket 11. The remaining portion of the left and right sides of first panel 14 have looped fastener strips 24 fixed (e.g., by sewing and/or adhesive) to panel 14. Top looped fastener strip 26 is similarly fixed to the top side of panel 14.

The left and right looped strips 24 cooperate with the left and right hooked strips 20 to releasably secure the left and right sides of weapon concealment pocket 11, while the looped and hooked fastener strips 26, 22 cooperate to secure the top side of concealment pocket 11. Together, the hook-and-loop closure provided by fastener strips 20, 22, 24 and 26 form releasable seam 18, which may also be augmented by snap fasteners as detailed below. Although the hooked portions of releasable seam 18 are fixed to main panel 12 and the looped portions are fixed to first panel 14, it is of course contemplated that this arrangement can be reversed as appropriate for a particular application. In one exemplary embodiment, hooked fastener strips 20, 22 and looped fastener strips 24, 26 are Velcro® brand connectors available from Velcro Industries B.V. of the Netherlands, or other non-branded equivalents thereof. However, it is also contemplated that other securement options may be used in place of the illustrated hook-and-loop fasteners, as required or desired for a particular application. Examples of alternative securement for releasable seam 18 include a series of buttons and other snap-fit fasteners, magnets, zippers, releasable adhesives, and various other materials that perform similarly to hook-and-loop fasteners but do not utilize a hook-and-loop arrangement.

In addition to the hook-and-loop securement provided along releasable seam 18, snap fasteners 50 may be provided at the upper right and upper left corners of weapon concealment pocket 11, as best seen in FIG. 4. In particular, male snap fasteners 50A are provided within the field of the hooked fastener strips 20, 22 at the upper left and upper right junctions thereof, e.g., male snap fasteners 50A are riveted in place directly onto the material of hooked fastener strips 20 and/or 22. Similarly, female snap fasteners 50B are provided at corresponding locations of looped fastener strips 24, 26, i.e., at the upper left and upper right junctions thereof, and are also riveted in place within the field of looped fastener strips 24, 26. When weapon concealment pocket 11 is configured in its closed configuration (FIG. 5), male and female snap fasteners 50A, 50B snap together to provide additional releasable fixation between the deployable portion 32 and main panel 12. As discussed below, these corner fasteners 50 mitigate the risk of accidental exposure of concealed carry storage area 30 while still allowing the user to readily access the same should the need arise.

As best seen in FIGS. 9 and 10, female snap fasteners 50B have a fastener head which remains behind flap 44 when pocket 11 is in the closed configuration (FIG. 5). This arrangement hides the presence of snap fasteners 50 behind flap 44 during normal use of coat 10, thereby ensuring that fasteners 50 do not provide any visual cue suggesting the presence of concealed storage area 30.

In an exemplary embodiment, corner snaps 50A, 50B are placed up to one-half inch from any adjacent edge of hooked or looped fastener strips 20, 22, 24, 26, respectively. This ensures that snap fastener 50 will be securely concealed within the field of hook-and-loop connection between deployable portion 32 and main panel 12, while also ensuring that continuity of the field of hook-and-loop connection is maintained. The presence of snap fasteners 50 at the upper right and upper left corners of pocket 11 provide significantly more strength of attachment at the corner regions of pocket 11, which are the most likely regions to catch or snag during daily use of coat 10. This additional strength prevents accidental deployment of deployable portion 32.

The hook-and-loop fastening along releasable seam 18 cooperates with the snap-fit fastening of fasteners 50 to provide a secure, continuous and positive attachment between deployable portion 32 of concealment pocket 11 and main panel 12. In an exemplary embodiment, the area occupied by releasable seam 18 may also be set as a function of the surface area occupied by deployable portion 32 of pocket 11. In particular, the area of deployable portion 32 is equal to the vertical extent DR of releasable seam 18 multiplied by the width W of concealment pocket 11 (which is equal to the width of releasable seam 18, as pocket W is shown in the shape of a rectangle). The aggregate area occupied by hooked fastener strips 20, 22 (which may be equal to the aggregate area of looped fastener strips 24, 26) may be as little as 25%, 27%, or 29% of the total area of deployable portion 32, or as much as 32%, 34%, or 36% thereof, or may be any percentage within any range defined by any pair of the foregoing values, such as between 25% and 36%, 27% and 34%, or 29% and 32%. Advantageously, the foregoing percentages of hook-and-loop fastener area provides for a secure and robust connection between deployable portion 32 and main panel 12 while also allowing a user of typical strength to easily and readily access concealed carry storage area 30 upon demand using the "tear away" method described herein.

An additional consideration addressed by the design of weapon concealment pocket 11 is the security of a weapon (such as firearm 54 shown in FIG. 7) within concealed carry storage area 30 when deployable portion 32 is in the fully open configuration (FIGS. 4 and 7). To this end, weapon concealment pocket 11 provides elastic mounting strips 58 and hook-and-loop mounting strips 60 in an alternating grid pattern, sometimes referred to as a MOLLE system. In addition, concealment pocket 11 provides a spatial arrangement of fixed seam 16 and releasable seam 18 which, in the context of the overall size and geometry of pocket 11, also adds security to weapon retention even with deployable portion 32 open. These features are described in turn below.

Figure 8:
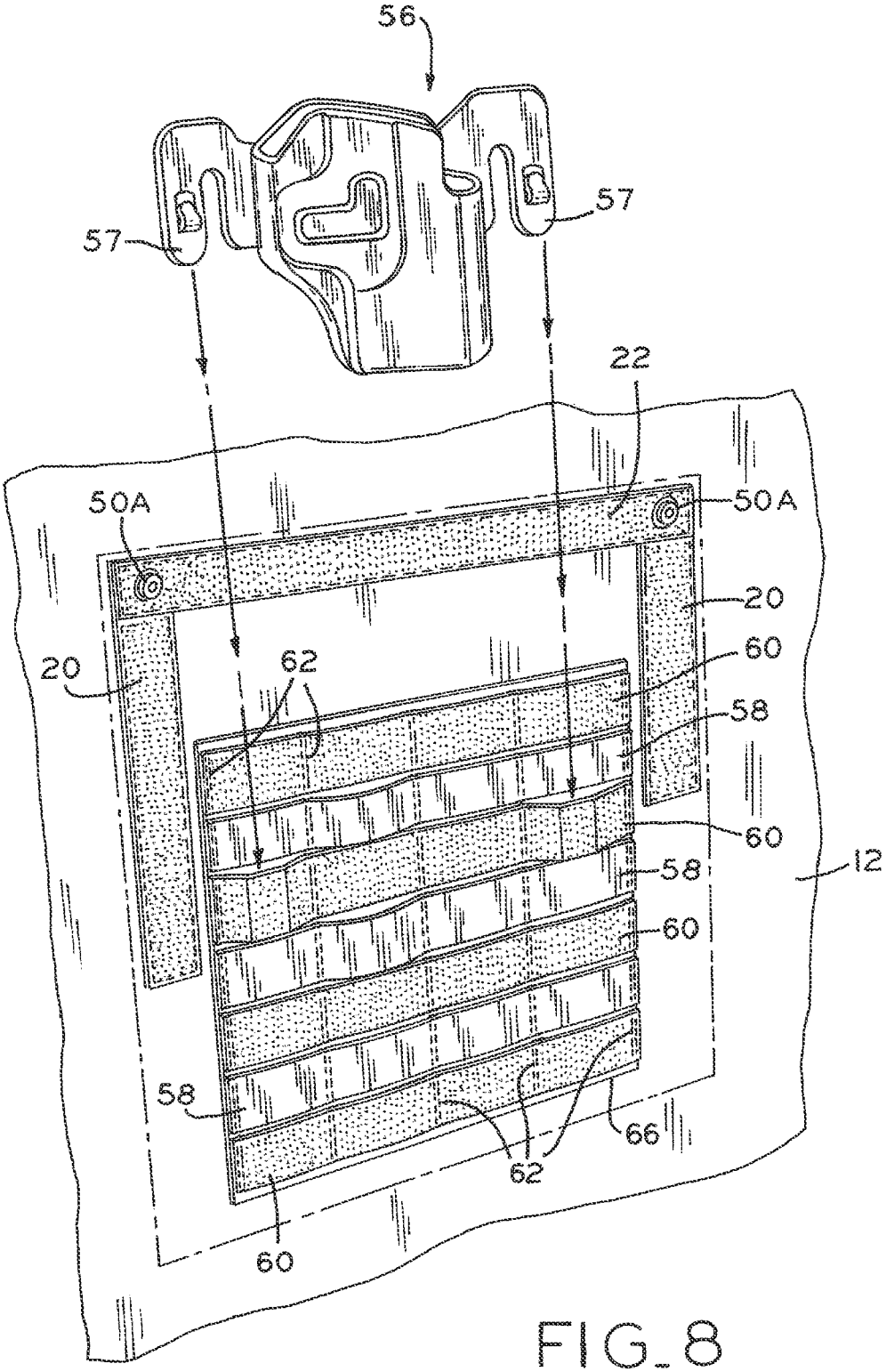
FIG. 8 is a perspective, exploded view of the weapon concealment pocket shown in FIG. 7, with the firearm and outer pocket panels removed for clarity.

An exemplary embodiment of the attachment grid used in weapon concealment pocket 11 is best shown in FIG. 8. As illustrated, alternating horizontal strips of hook-and-loop mounting strips 60 and elastic mounting strips 58 are joined to firearm mounting panel 66, which in turn is fixed (e.g., by sewing and/or adhesive) to main panel 12. Vertical seams 62 fix strips 58 and 60 to panel 66 at regular intervals in order to provide the illustrated "grid" of attachment points for a variety of mounting options. In an exemplary embodiment, the grid of elastic mounting strips 58 and hook-and-loop mounting strips 60 are arranged according to a modified MOLLE convention (MOLLE being an acronym for MOdular Lightweight Load-carrying Equipment) utilized by NATO armed forces, including the U.S. Army. In particular, mounting strips 58 and 60 may each by 1" wide, and seams 62 may be separated at 1.5" intervals.

This MOLLE arrangement provides for the use of many standardized components and weapon systems, such as holster 56 as shown in FIG. 8. As illustrated, holster 56 includes holster attachment arms 57 which are sized and configured to interface with the MOLLE attachment grid and, therefore, may be securely attached to one of mounting strips 58, 60. In typical use of coat 10, hook-and-loop mounting strips 60 are preferable for mounting holster 56 in order to provide for a secure, non-elastic connection between holster 56 and concealed carry storage area 30.

In addition to the MOLLE grid disposed in storage area 30, the spatial arrangement of fixed seam 16 and releasable seam 18 provides for additional secure fixation of a weapon system within concealed carry storage area 30. In particular, referring to FIG. 4, fixed seam 16 has a vertical extent DF sufficient to ensure that the distal end of the weapon system contained in storage area 30 is always securely "sandwiched" between main panel 12 and first panel 14. This, in turn, prevents accidental inversion of the weapon system and precludes accidental/gravitational withdrawal of firearm 54 from holster 56 under the force of (FIG. 7). In particular, the vertical extent DR of releasable seam 18 may occupy a specified maximum portion of the overall vertical extent DT of pocket 11, thereby leaving the remaining portion of the vertical extent, namely vertical extent DF of fixed seam 16, always intact for secure retention of the weapon system. In an exemplary embodiment, vertical extent DF of fixed seam 16 may be as little as 45%, 50%, 55%, or 60% of vertical extent DT, or as much as 70%, 75%, or 80% thereof, or may be any vertical extent within any range defined by the foregoing values, such as between 45% and 80%, 50% and 75%, or 55% and 70%. Moreover, in the context of firearm 54, vertical extent DF of fixed seam 16 may be at least four inches in order to retain at least the bottom half of a wide range of handheld firearms 54 within non-deployable portion 34 of concealment pocket 11.

In addition to secure retention of a weapon system in concealed carry storage area 30, weapon concealment pocket 11 also offers comprehensive concealment of the weapon system and/or accessories contained therein, with minimal or nonexistent "printing" visible to an observer of the user of coat 10. This concealment is achieved with a combination of pleats 46, 48 and the materials and construction used for weapon concealment pocket 11, as detailed below.

First panel 14 and second panel 40 (FIG. 4) cooperate to define top access cargo pocket 42, and are both positioned exterior of concealed carry storage area 30. This arrangement places two layers of material between storage area 30 and the exterior of pocket 11, which in turn mitigates the potential for printing. In an exemplary embodiment, the interior of cargo pocket 42 may be formed of quilted material to provide further padding and thereby further prevent printing.

In addition, outer pleat 46 (FIGS. 5 and 6) is formed in outer panel 40, and inner pleat 48 (FIGS. 4 and 14) is formed in first panel 14. Each of pleats 46, 48 allows for horizontal and vertical expansion of the outer surface of pocket 11, thereby allowing the visible outer surface to "bulge" uniformly in reaction to the presence of cargo in storage area 30 and/or cargo pocket 42. This uniform bulging appearance at the exterior of pocket 11 avoids any printing on the otherwise telltale shape of, e.g., firearm 54 from passing through first and second panels 14, 40 when concealed carry storage area 30 is occupied. Rather, the expansion of pleats 48, 46 merely gives the appearance of generic cargo contained in top access cargo pocket 42. In one embodiment, shown in FIG. 7, elastic pleat backing 64 may be provided at the interior surface of inner pleat 48, in order to restrain the expansion of inner pleat 48 when a weapon system such as firearm 54 is contained within concealed carry storage area 30. In other embodiments, such as are shown in FIGS. 4 and 14, elastic pleat backing 64 may be omitted.

In use, a user of coat 10 may deposit a weapon system, such as firearm 54 and holster 56, in either the right or left pocket 11 of coat 10. In this way, coat 10 provides an ambidextrous weapon concealment system, in that right handed and left handed users may conceal firearm 54 in whatever position and orientation as desired by the user. In some instances, accessories may be placed in the pocket not contacting the weapon system, such as shown in FIG. 14. For example, spare ammunition magazines 55 may be secured in the concealed carry storage area 30 not housing firearm 54.

In an exemplary embodiment, magazines 55 are secured within storage area 30 using portions of the elastic mounting strips 58 of the MOLLE grid in storage area 30. The material of elastic mounting strips 58 is rated to expand to at least 2.17 times its relaxed length, such that objects with a total girth of 4.5" or less can be retained within any one of the 1.5" wide elastic sections between neighboring seams 62. This configuration ensures that standard firearm magazines 55 for a wide variety of firearm makes and models can be retained by elastic mounting strips 58.

In addition, further accessories and weapon systems can be affixed by hook-and-loop attachment to the hook-and-loop mounting strips 60 provided on the MOLLE grid. In an exemplary embodiment, shown in FIG. 8, the MOLLE grid provided in accordance with the present disclosure has at least four (4) 1.5" wide columns of securement points and at least six (6) rows of strips 58, 60, which provide sufficient surface area to mount or otherwise attach a wide variety of firearms, other weapon systems, or other items. Similarly, width W of pocket 11 (FIG. 4) may be at least 6.25", which also provides sufficient space to accommodate and conceal a large number of firearms or other weapon systems.

Figure 12:
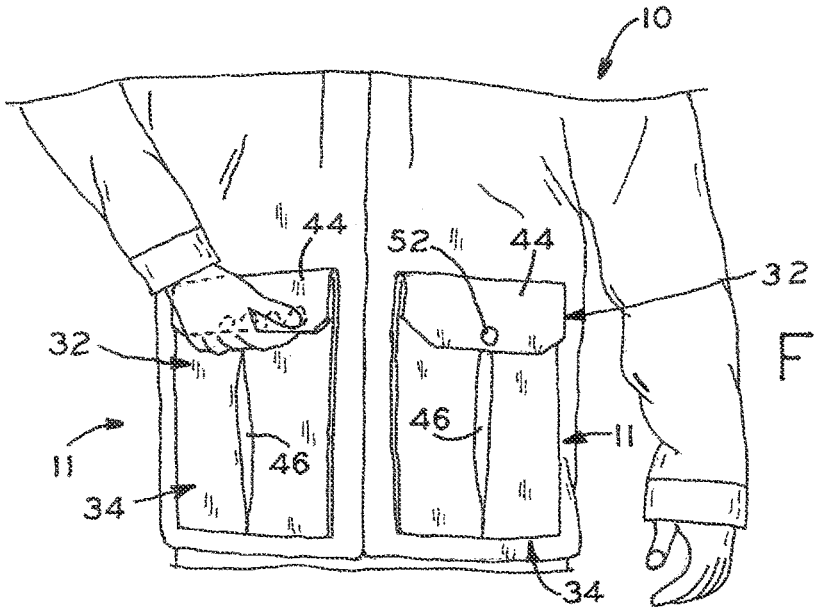
FIG. 12 is a front elevation view of a portion of the coat shown in FIG. 1, illustrating a user grasping a flap of the weapon concealment pocket in preparation for access to the concealed carry storage area.
Figure 13:
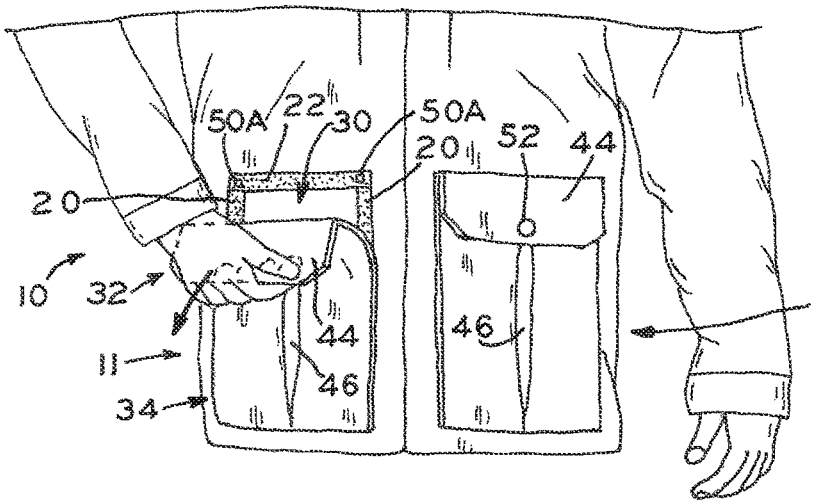
FIG. 13 is another front elevation view of the coat shown in FIG. 12, illustrating the user exposing the concealed carry storage area.

If the user of coat 10 is called upon to deploy his or her concealed weapon system, the structure and function of weapon concealment pocket 11 facilitates rapid, reliable, and effective access to the weapon system and other items contained therein. FIGS. 12-14 illustrate an exemplary deployment process.

In FIG. 12, both concealment pockets 11 are in there fully closed configurations. As illustrated, the user of coat 10 grasps flap 44 of cargo pocket 42 to initiate the deployment process. In an exemplary embodiment, flap 44 is sized to allow the user to easily gain a firm and complete grasp of flap 44 in order to facilitate positive and reliable engagement between the user's hand and the flap 44.

For example, flap 44 may define a height F of as little as 3 inches, 3.5 inches, or 4 inches, or as much as 5 inches, 5.5 inches, or 6 inches, or flap height F may be any height within any range defined by the foregoing values, such as between 3 inches and 6 inches, 3.5 inches and 5.5 inches, or 4 inches and 5 inches. Advantageously, the foregoing flap height F is sufficiently large for a user of average size to grasp to flap 44 completely or substantially completely with one hand, i.e., with the thumb and multiple fingers. For example, material from flap 44 may extend the entire length of the user's fingers and engage the user's palm, which provides for a large-area grasp by the user. This allows the user to easily exert substantial force when pulling deployable portion 32 away from main panel 12 as further described below. At the same time, the above-described vertical extent F for flap 44 is within a normal range for conventional pocket flaps on coats such as coat 10, such that the size and configuration of flap 44 does not provide any visual cue regarding the presence of concealed carry storage area 30.

Moreover, the inventors have determined that the above-described size and configuration of flap 44, in cooperation with the overall structure and function of concealment pocket 11, provides for a highly reliable deployment of deployable portion 32, which is also forgiving of errors by a user under extreme stress. For example, the large vertical extent F of flap 44 allows a user of coat 10 to firmly and reliably grasp flap 44 in high-stress situations, despite any loss of fine motor skills which may occur during such situations. The relatively large width W of flap 44 also allows the user to grasp any part of flap 44, including either corner and the middle portion of flap 44, while still obtaining sufficient material to ensure that the user reliably gains full access to concealed carry storage area 30 on the first attempt. Still further, the location of pocket 11 at the natural "hip pocket" location shown in FIG. 1 allows the user to access concealed carry storage area 30 with a minimum of arm and body movement, thereby promoting highly reliable access to the weapon system or other items contained in storage area 30.

Figure 11:
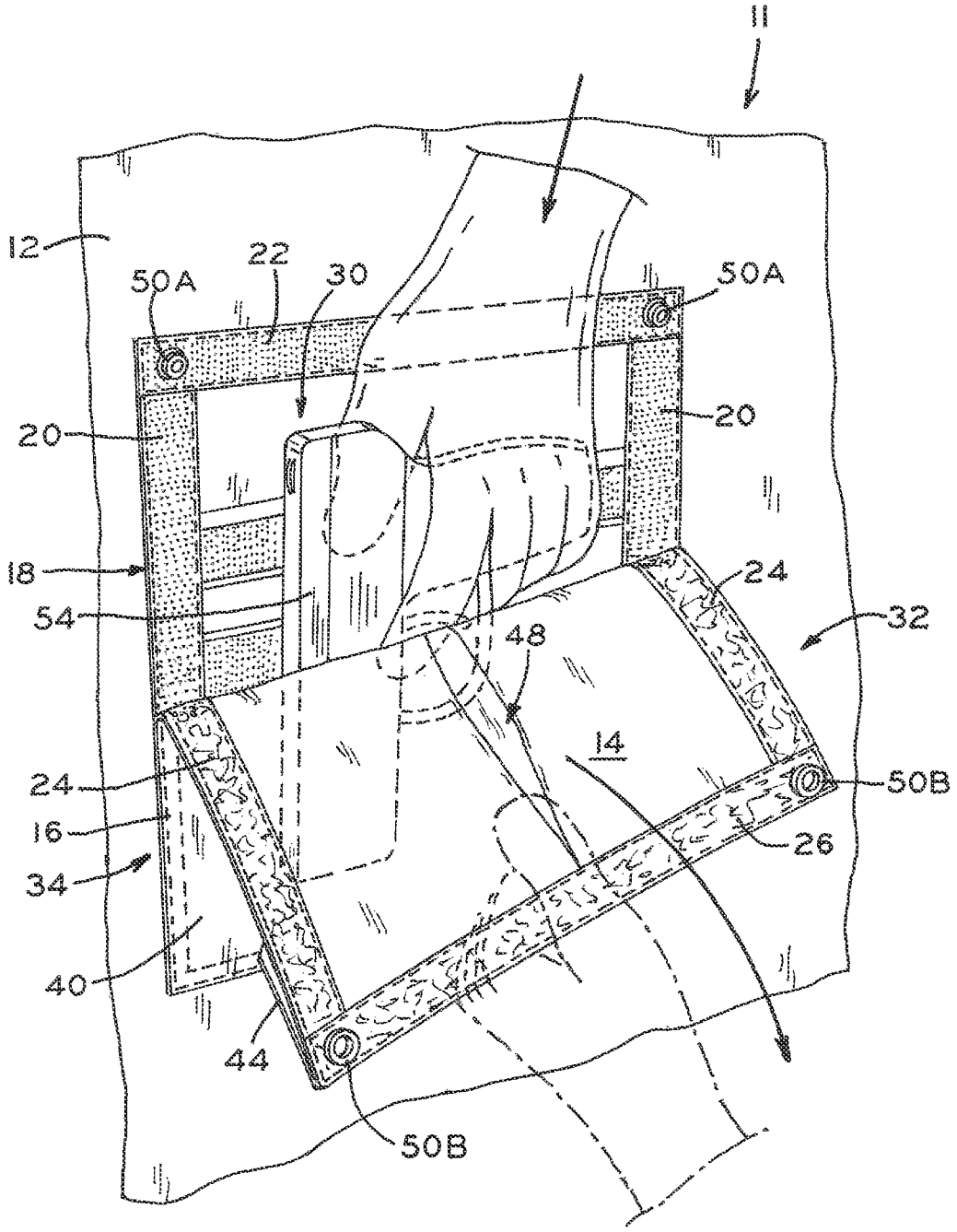
FIG. 11 is a perspective view of a weapon concealment pocket in accordance with the present disclosure, illustrating a user grasping a firearm contained within the concealed pocket thereof.

Turning now to FIG. 13, with flap 44 firmly grasped within the user's hand, the user pulls downwardly and outwardly to disengage female corner snap fasteners 50B (FIG. 11) from the male corner snap fasteners 50A, while simultaneously disengaging looped fastener strips 24, 26 from hooked fastener strips 20, 22, respectively. This disengagement may be accomplished with the user's strong-side hand, as shown in FIG. 13 or with the opposing weak side hand, as shown in FIG. 11. A user's strong side is typically considered to be the user's dominant hand for weapon deployment, such as the right hand for a right-handed shooter. By contrast, the user's weak side is the side opposite the strong side. As deployable portion 32 is disengaged from main panel 12, concealed carry storage area 30 becomes exposed.

Turning now to FIG. 14, deployable portion 32 is shown in a fully deployed and open position, with concealed carry storage area 30 fully exposed and firearm 54 easily accessible. In order to facilitate the full and complete deployment of deployable portion 32 without any damage to pocket 11 and/or excessive exposure of storage area 30, bartacks 36 (FIG. 4) may be provided at the junction between fixed seam 16 and releasable seam 18. Bartacks 36 provide a robust bowl work against fraying of fixed seam 16 due to forceful opening of deployable portion 32.

With the concealed carry storage area 30 fully exposed as shown in FIGS. 11 and 14, the user of coat 10 may grasp firearm 54 and withdraw the same from holster 56 (FIG. 14) as required by the situation and circumstances presented to the user. Advantageously, the above-described arrangement of vertical extents DF and DR of fixed and releasable seams 16 and 18, respectively, cooperate with the provision and positioning of the modified MOLLE grid of strips 58 and 60 to allow the user to position firearm 54 and holster 56 at a desired location and angle within concealed carry storage area 30 for reliable access. In particular, the entire proximal portion of firearm 54 is presented to the user when deployable portion 32 of pocket 11 is in the open configuration, including the entire grip and any grip-mounted safety mechanisms, the rear portion of the slide and any slide-mounted safety mechanisms, and at least a portion of the trigger guard. In addition, any release mechanism which may be present on holster 56 is also exposed by opening deployable portion 32. Thus, the user can easily gain a firm and secure grip on firearm 54 when needed, despite the potential lack of fine motor skills which may accompany emergency situations as noted above. As also noted above with respect to the opening of deployable portion 32, the location of pocket 11 positions firearm 54 near the user's hip for minimum arm and body movement in grasping firearm 54 and, therefore, maximum deployability thereof.

Referring still to FIG. 14, the other concealment pocket 11 may be opened in a similar fashion to the weapon-bearing pocket 11 in order to expose any accessories or other weapon systems contained therein. In the illustrated embodiment, magazines 55 may be contained in the weak-side pocket 11 for reloading firearm 54 as necessary. As described above with respect to the strong-side pocket 11, the configuration of pocket 11 on the weak side also facilitates simple, reliable and repeatable access to magazines 55 or other items retained in concealed carry storage area 30 as needed.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An article of apparel, comprising:

a main panel having a front side;

a first panel having a front side, a rear side, and first periphery, said first periphery including a top side, a bottom side, a left side, and a right side, said first panel fixably secured to said main panel along a fixed first seam including said bottom side and a fixed portion of a total vertical extent of each of said left and right sides, said first panel releasably secured to said main panel along a releasable second seam including said top side and a releasable portion of said total vertical extent of each of said left and right sides by hook and loop fastener strips;

said fastener strips including first strips fixably secured to and extending respectively along said rear side of said first panel and along said top side and said portions of said vertical extents of each of said left and right sides of said first panel, and second strips fixably secured to and extending along portions of an underlying periphery of said front side of said main panel corresponding to respective locations of said first strips, said first and second strips releasably securable to one another;

a first pocket defined between said main panel and said first panel, said first pocket defining an upper portion and a lower portion;

said lower portion bounded by said front side of said main panel, said rear side of said first panel, and said fixed first seam, and said upper portion bounded by said front side of said main panel, said rear side of said first panel, and said releasable second seam, said upper portion exposable upon release of said releasable second seam;

a second panel defining a second periphery substantially co-extensive with said first periphery, said second periphery including a top side, a bottom side, a left side, and a right side, said second panel fixably secured to said first panel along said bottom side and along each of said left and right sides, with a second pocket defined between said first and second panels; and a flap fixably secured along said top side of said first panel, said flap overlapping said top side of said second panel.

2. The article of apparel of claim 1, wherein said releasable portion of said total vertical extent has a length of at most 55% of said total vertical extent, and said fixed portion has a length of the remaining portion of said total vertical extent.

3. The article of apparel of claim 1, wherein said second panel has an outer pleat extending vertically and disposed between said left side and said right side of said second panel.

4. The article of apparel of claim 3, wherein said first panel has an inner pleat extending vertically and disposed between said left side and said right side of said first panel.

5. The article of apparel of claim 1, further comprising a pair of snap fasteners releasably connecting pairs of respective corner regions of said main and first panels at opposite ends of said top sides of said main and first panels, said snap fasteners each including respective male and female components each disposed within an area of one of said first and second strips.

6. The article of apparel of claim 1, further comprising a holster releasably mounted within said first pocket.

7. The article of apparel of claim 6, wherein said first pocket includes a mounting system including a series of rows of adjacent material loops secured to said front side of said main panel, said holster mounted to selected ones of said material loops.

8. The article of apparel of claim 1, further comprising a third pocket disposed behind said main panel, said third pocket having an access opening in registry with one of said left and right sides of said first panel.

9. The article of apparel of claim 1, wherein said flap has a vertical dimension aligned with said vertical extent, said vertical dimension at least 25% of said vertical extent.

10. The article of apparel of claim 1, wherein said upper portion of said first pocket defines an upper portion area and said first fastener strips together define a first fastener strip area, said first fastener strip area between 25% and 36% of said upper portion area.

11. An article of apparel, comprising:

a main panel having a front side;

a weapon mounting panel fixed to said main panel and adapted to receive a weapon system;

a first portion of a releasable seam fixed to said main panel and having left side, right side and top portions;

a cargo pocket having a non-deployable bottom portion fixed to the main panel by a fixed seam and a deployable top portion releasably secured to the main panel by said releasable seam, said weapon mounting panel disposed between said main panel and said cargo pocket, said fixed seam of said non-deployable bottom portion having a vertical extent of at least 45% of an overall vertical extent defined by said cargo pocket, said cargo pocket comprising:

a first panel having a second portion of said releasable seam secured to a rear side of said first panel, said second portion of said releasable seam having left side, right side and top portions sized and positioned to cooperate with said left side, right side and top portions of said first portion of said releasable seam to selectively secure said deployable top portion to said main panel;

a second panel fixed to said first panel with along respective sides and along a bottom, such that said first panel and said second panel cooperate to define said cargo pocket with an open upper end; and a flap fixedly secured along a top side of said first panel and selectively covering said open upper end, said flap defining a flap height of at least 3 inches whereby said flap can be firmly grasped by a user of the article of apparel to release said deployable top portion from said main panel.

12. The article of apparel of claim 11, wherein said first portion of said releasable seam comprises one of a hooked fastener strip and a looped fastener strip, and said second portion of said releasable seam comprises the other of said hooked fastener strip and said looped fastener strip.

13. The article of apparel of claim 12, wherein said deployable top portion of said cargo pocket defines a deployable portion area and said first portion of said releasable seam defines a first fastener strip area, said first fastener strip area between 25% and 36% of said deployable portion area.

14. The article of apparel of claim 11, further comprising:

a first portion of a snap fastener in each of an upper right corner and an upper left corner of said first portion of said releasable seam; and a second portion of said snap fastener in each of an upper right corner and an upper left corner of said second portion of said releasable seam, each said first portion cooperating with a respective one of said second portion to provide additional selective fixation of said deployable top portion to said main panel.

15. The article of apparel of claim 11, wherein said second panel has at least one pleat extending vertically and disposed between said left side and said right side of said second panel.

16. The article of apparel of claim 1, wherein a cargo pocket is defined between said first panel and said second panel.

17. The article of apparel of claim 1, wherein said flap has an area of at least 25% of an area of said first panel, said first panel area defined within said first periphery.

18. The article of apparel of claim 5, wherein said snap fasteners each include a first head disposed between said main panel and said first panel, and a second head disposed between said first panel and said flap, wherein said snap fasteners are hidden from view externally of said article of apparel.

19. The article of apparel of claim 1, wherein said flap defines a vertical flap height of at least 3 inches.

20. The article of apparel of claim 14, wherein said first portions of said snap fasteners are disposed between said main panel and said first panel, and said second portions of said snap fasteners are disposed between said first panel and said flap, wherein said snap fasteners are hidden from view externally of said article of apparel.

* * * * *